US012139926B2

(12) United States Patent
Lu et al.

(10) Patent No.: US 12,139,926 B2
(45) Date of Patent: Nov. 12, 2024

(54) FOLDING TENT EAVE AUTOMATICALLY-OVERHANGING STRUCTURE APPLICABLE TO EAVE OVERHANGING RODS IN VARIOUS LENGTHS

(71) Applicant: Nengxiao Lu, Zhejiang (CN)

(72) Inventors: Nengxiao Lu, Zhejiang (CN); Xingchen Lu, Zhejiang (CN)

(73) Assignee: Nengxiao Lu, Zhejiang (CN)

( * ) Notice: Subject to any disclaimer, the term of this patent is extended or adjusted under 35 U.S.C. 154(b) by 208 days.

(21) Appl. No.: 18/073,571

(22) Filed: Dec. 2, 2022

(65) Prior Publication Data

US 2024/0026704 A1 Jan. 25, 2024

(30) Foreign Application Priority Data

Jul. 19, 2022 (CN) ..... 202221869354.6

(51) Int. Cl.
*E04H 15/48* (2006.01)

(52) U.S. Cl.
CPC ..... *E04H 15/48* (2013.01)

(58) Field of Classification Search
CPC ..... E04H 15/16; E04H 15/48; E04H 15/50; E04H 15/58
See application file for complete search history.

(56) References Cited

U.S. PATENT DOCUMENTS

| | | | | |
|---|---|---|---|---|
| 9,926,720 | B2 * | 3/2018 | Huang | E04H 15/54 |
| 10,041,272 | B2 * | 8/2018 | Choi | E04H 15/50 |
| 10,113,329 | B2 * | 10/2018 | Choi | E04H 15/46 |
| 10,119,297 | B2 * | 11/2018 | Choi | E04H 15/50 |
| 10,697,196 | B2 * | 6/2020 | Nicholson, Jr. | E04H 15/58 |
| 10,982,466 | B2 * | 4/2021 | Huang | E04H 15/50 |
| 11,072,943 | B2 * | 7/2021 | Sun | E04H 15/32 |
| 11,230,858 | B2 * | 1/2022 | Yuan | E04H 15/48 |
| 11,988,008 | B2 * | 5/2024 | Xu | E04F 10/02 |
| 12,037,808 | B2 * | 7/2024 | Sun | E04H 15/50 |
| 2017/0292287 | A1 * | 10/2017 | Lovley, II | E04H 15/60 |
| 2018/0080242 | A1 * | 3/2018 | Choi | E04H 15/58 |
| 2018/0106068 | A1 * | 4/2018 | Choi | E04H 15/46 |

FOREIGN PATENT DOCUMENTS

CN 215255079 12/2021

* cited by examiner

*Primary Examiner* — Noah Chandler Hawk
(74) *Attorney, Agent, or Firm* — JCIPRNET

(57) ABSTRACT

A folding tent eave automatically-overhanging structure includes a leg pipe, a fixed base disposed at an upper part of the leg pipe, a slide base disposed on the leg pipe and capable of sliding up and down along the leg pipe, and an eave overhanging rod movably erected on the fixed base. The fixed base is hingedly connected to a lower tent top rod. The slide base is hingedly connected to a support rod. The other end of the support rod is hingedly connected to the lower tent top rod. A slider capable of sliding along the support rod is disposed on the support rod. The slider is hingedly connected to a connecting rod. The other end of the connecting rod is hingedly connected to the lower tent top rod. The folding tent eave automatically-overhanging structure further includes a push rod.

10 Claims, 17 Drawing Sheets

FOLDING TENT EAVE AUTOMATICALLY-OVERHANGING STRUCTURE APPLICABLE TO EAVE OVERHANGING RODS IN VARIOUS LENGTHS

CROSS-REFERENCE TO RELATED APPLICATION

This application claims the priority benefit of China application serial no. 202221869354.6, filed on Jul. 19, 2022. The entirety of the above-mentioned patent application is hereby incorporated by reference herein and made a part of this specification.

BACKGROUND

Technical Field

The present invention relates to the technical field of outdoor folding tents, and more particularly to a folding tent eave automatically-overhanging structure applicable to eave overhanging rods in various lengths.

Description of Related Art

The alias of the folding tent is an advertising tent and an awning. The folding tent can be used for outdoor exhibitions and product promotion, celebration evenings, exhibitions, tourism, leisure, field work, and food stalls. The folding tent can also be used for song and dance evenings and other temporary activities, as well as long-term leisure facilities in a park tourist resort scenic area. The folding tent is simple to operate, and easy to mount. In order to facilitate carry, particularly some small and medium-sized folding tents, the unfolded internal space thereof is relatively small. In order to improve the sun-shading area of an unfolded tent, an eave overhanging tent having an eave overhanging structure is provided. The tent is provided with an extended eave overhanging rod at a roof corner, and achieves the objective of improving the sun-shading area by means of a surrounding edge disposed on the eave overhanging rod.

For this reason, the patent No. CN215255079U discloses an automatic eave overhanging mechanism for a folding tent, including a tent leg pipe and tent support rod for supporting a tent top tarpaulin, wherein the tent leg pipe is provided with a mounting base at an upper part; one end of the tent support rod is mounted on the mounting base; the tent leg pipe is further provided with a slide base capable of sliding up and down along the tent leg pipe; the slide base is hingedly connected to an inclined rod; the other end of the inclined rod is hingedly connected to the tent support rod; the mounting base is hingedly connected to an eave overhanging sleeve; an eave overhanging rod is mounted in cooperation with the eave overhanging sleeve; the eave overhanging rod can extend and retract along the eave overhanging sleeve; the automatic eave overhanging mechanism further includes a linkage rod, wherein an inner end of the linkage rod is hingedly connected to the tent support rod; a position at which the linkage rod is hingedly connected to the tent support rod is on an inner side of a position at which the inclined rod is hingedly connected to the tent support rod; the inclined rod is provided thereon with a slide apparatus; the linkage rod is hingedly connected to the slide apparatus; and an inner end of the eave overhanging rod is hingedly connected to the linkage rod. However, in the design, the eave overhanging rod is bending; when the folding tent is unfolded, the eave overhanging rod retracts inward and is received in the folding tent; four bending eave overhanging rods and other rods are easy to interfere and contact each other. Therefore, a sufficient accommodation space must be provided, such that the volume of the unfolded folding tent is large, thereby improving the package, transportation, and storage costs.

For exported folding tent products, shipping cost occupies a high percent, and therefore the transportation volume and package volume of the product are severely limited. In order to facilitate transportation, the volume must be reduced. However, the bending eave overhanging rod is easy to interfere and contact an upper tent top rod when the folding tent is unfolded. Furthermore, the eave overhanging rod is located on one side of a lower tent top rod. In order to stagger the upper tent top rod from the eave overhanging rod, the upper tent top rod is necessarily hingedly connected to the lower tent top rod in an abutment manner; that is, the two rods are connected end to end by means of a hinge, and are located on the same plane, as shown in FIG. 17 and FIG. 18. However, such hinge mode has a poor transverse stability, is easy to bend, and causes the phenomena of unstable tent roof and loose tarpaulin.

SUMMARY

The objective of the present invention is to provide a folding tent eave automatically-overhanging structure applicable to eave overhanging rods in various lengths. The present invention is used to solve the above technical problems, and provides an eave overhanging structure with high steadiness. Furthermore, according to use requirements, overhanging eaves in different lengths can be provided. Compared with the conventional eave overhanging structure, the overhanging eave of the present invention can extend longer, thereby enriching the configuration space of the overhanging eaves of the folding tent.

The technical problems to be solved by the present invention may be implemented by adopting the following technical solutions:

A folding tent eave automatically-overhanging structure applicable to eave overhanging rods in various lengths, including a leg pipe, a fixed base disposed at an upper part of the leg pipe, a slide base disposed on the leg pipe and capable of sliding up and down along the leg pipe, and an eave overhanging rod movably erected on the fixed base and capable of extending outward and retracting inward. The fixed base is hingedly connected to a lower tent top rod. The slide base is hingedly connected to a support rod. An end of the support rod is hingedly connected to the lower tent top rod. A slider capable of sliding along the support rod is disposed on the support rod. The slider is hingedly connected to a connecting rod. An end of the connecting rod is hingedly connected to the lower tent top rod. A position at which the connecting rod is hingedly connected to the lower tent top rod is closer to a central position of the folding tent eave automatically-overhanging structure than a position at which the support rod is hingedly connected to the lower tent top rod. The folding tent eave automatically-overhanging structure further includes a push rod. One end of the push rod is hingedly connected to the slider and/or the connecting rod. An end of the push rod is hingedly connected to the eave overhanging rod and/or a pull rod. An end of the pull rod is hingedly connected to the lower tent top rod and/or the support rod. When the folding tent is unfolded, the slide base moves upward, the support rod pushes the lower tent top rod to unfold, the lower tent top rod drives the connecting rod to pull the slider, in combination with the action of the pull rod, the push rod deflects. Finally, the eave overhanging rod moves upward and deflects, so as to complete an outward extension of the eave overhanging rod.

The end of the pull rod is hingedly connected to the lower tent top rod at a position between the position at which the connecting rod is hingedly connected to the lower tent top rod and the position at which the support rod is hingedly connected to the lower tent top rod.

The end of the pull rod is hingedly connected to the lower tent top rod at the same position that the support rod is hingedly connected to the lower tent top rod.

The end of the pull rod is hingedly connected to the support rod.

An inner end of the eave overhanging rod is hingedly connected to the pull rod.

An inner end of the eave overhanging rod is hingedly connected to the push rod.

The corresponding hinged connection ends of the pull rod, the push rod, and the eave overhanging rod are hingedly connected at the same point.

An accommodation groove is disposed on the pull rod; and the accommodation groove is used to correspond to the position at which the support rod is hingedly connected to the lower tent top rod.

The slider includes a slide sleeve portion and a mounting portion. The slide sleeve portion is sleeved on the support rod and can slide along the support rod, and the mounting portion is hingedly connected to the push rod and the connecting rod.

An eave overhanging slide sleeve is disposed between the eave overhanging rod and the fixed base, and the eave overhanging rod penetrates through the eave overhanging slide sleeve and extends outward.

Compared with the prior art, the present invention has the following prominent advantages and effects: in the present invention, the eave overhanging rod can extend and retract by using the position changes of the connecting rod, the push rod, and the pull rod; the hinge position relationships between the pull rod, the connecting rod and the lower tent top rod are optimized; the eave overhanging rods in various lengths can be selected; the extension length of the eave overhanging rod can be improved, thereby realizing a folding tent with extended eave overhanging rods; the eave overhanging rod uses a straight rod structure, and the components are designed in a staggered manner, thereby realizing no interference and contact after the tent is folded; the eave overhanging rod is at a position in parallel with the upper tent top rod and the lower tent top rod after the tent is folded, thereby reducing the overall size of the folded tent, saving space to the most extent, reducing the volume of the overall package, facilitating transportation and storage, and reducing cost; the structural design of the connector and the eave overhanging slide sleeve is optimized, thereby improving the transverse fixation firmness of the components, improving the overall mounting strength, preventing the eave overhanging rod from shaking after the tent is folded, and improving the tarpaulin stretching effect.

The features of the present invention can be clearly understood with reference to the drawings and the detailed description of the following preferred embodiments.

DESCRIPTION OF THE EMBODIMENTS

Figure 1:
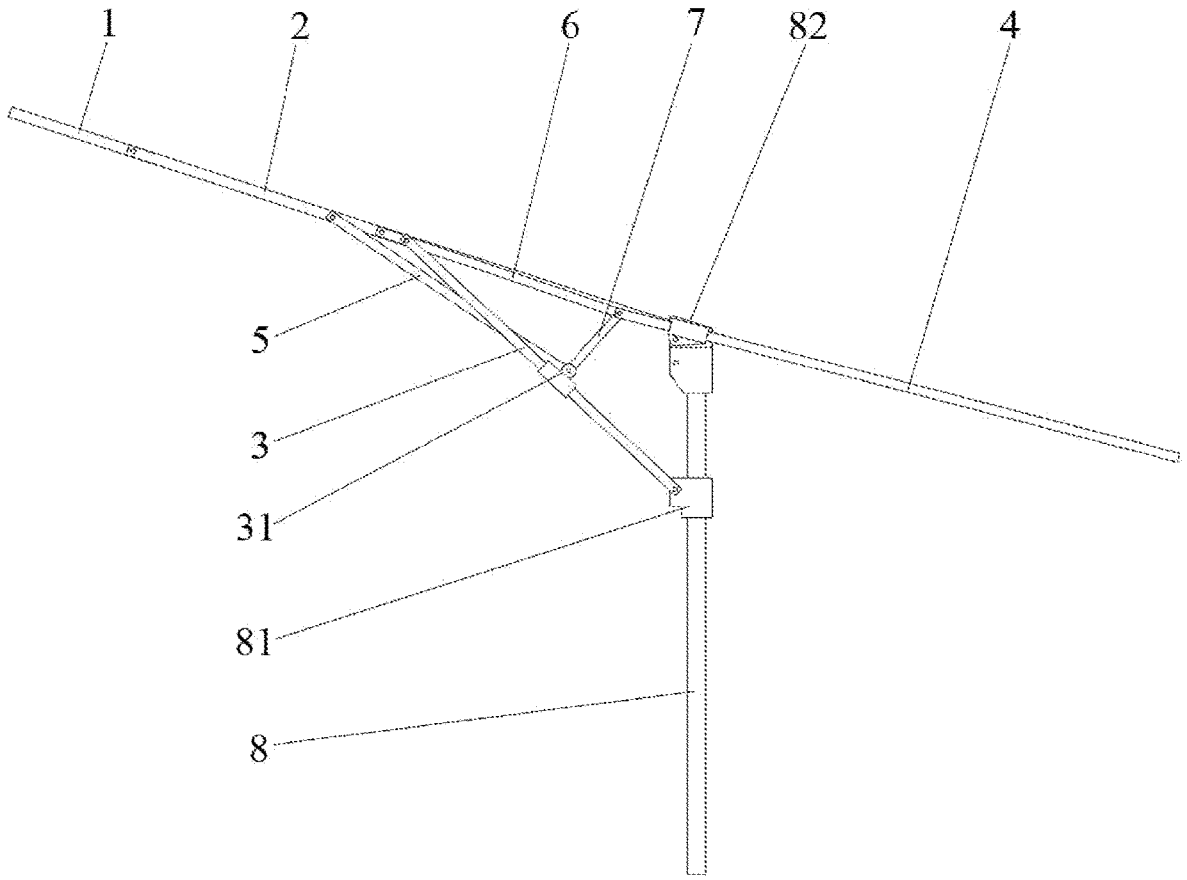
FIG. 1 is a first overall structural diagram of an unfolded overhanging eave according to the present invention.

In order to easily understand the technical means, creative features, objectives, and effects achieved by the present invention, the present invention will be further described below with reference to specific drawings.

It should be noted that all the directional indications (such as up, down, left, right, front, back, . . . ) in the embodiments of the present invention are only used to explain a relative position relationship, motion situation and the like between components under a specific attitude (as shown in the drawings), and if the specific attitude changes, then the directional indications also change accordingly. In addition, the descriptions of "first", "second" and the like in the present invention are used for the purpose of description only, but cannot be understood to indicate or imply the relative importance thereof or implicitly indicate the number of the indicated technical features. Therefore, a feature defined by "first" or "second" may explicitly or implicitly include at least one feature.

Embodiment 1

As shown in FIG. 1 to FIG. 16, the present embodiment discloses a folding tent eave automatically-overhanging structure applicable to eave overhanging rods in various lengths, including a leg pipe 8, an upper tent top rod 1, a lower tent top rod 2, and a support rod 3, wherein the leg pipe 8 is provided with a fixed base 82 at an upper part; the fixed base 82 is hingedly connected to the lower tent top rod 2; the leg pipe 8 is further provided with a slide base 81 capable of sliding up and down along the leg pipe 8; the slide base 81 is hingedly connected to the support rod 3; the other end of the support rod 3 is hingedly connected to the lower tent top rod 2; the upper tent top rod 1 and the lower tent top rod 2 are preferably hingedly connected in a staggered manner; the upper parts of the upper tent top rod 1 and the lower tent top rod 2 are used to support tarpaulin; and one end of the upper tent top rod 1 is generally hingedly connected to a central top. The above structure is a common folding tent structure in the prior art.

On the basis of the above description, in the present embodiment, a slider 31 capable of sliding along the support rod is disposed on the support rod 3; the slider 31 is hingedly connected to a connecting rod 5; the other end of the connecting rod 5 is hingedly connected to the lower tent top rod 2; a position at which the connecting rod 5 is hingedly connected to the lower tent top rod 2 is closer to a central position of the folding tent than a position at which the support rod 3 is hingedly connected to the lower tent top rod 2.

The folding tent eave automatically-overhanging structure further includes a push rod 7, wherein one end of the push rod 7 is hingedly connected to the slider 31 and/or the connecting rod 5, and the other end of the push rod 7 is hingedly connected to an eave overhanging rod 4 and/or a pull rod 6; the other end of the pull rod 6 is hingedly connected to the lower tent top rod 2; a position at which the pull rod 6 is hingedly connected to the lower tent top rod 2 is at any one of a position at which the connecting rod 5 is hingedly connected to the lower tent top rod 2 and a position at which the support rod 3 is hingedly connected to the lower tent top rod 2; the eave overhanging rod 4 is movably erected on the fixed base 82, and can extend outward and retract inward; when the folding tent is unfolded, the slide base 81 moves upward; the support rod 3 pushes the lower tent top rod 2 to unfold; the lower tent top rod 2 drives the connecting rod 5 and the pull rod 6; in combination with the action of the push rod 7, the eave overhanging rod 4 completes movable outward extension. In a preferred embodiment, the position at which the pull rod 6 is hingedly connected to the lower tent top rod 2 is between the position at which the connecting rod 5 is hingedly connected to the lower tent top rod 2 and the position at which the support rod 3 is hingedly connected to the lower tent top rod 2, preferably in the middle; the position at which the pull rod 6 is hingedly connected to the lower tent top rod 2, the position at which the connecting rod 5 is hingedly connected to the lower tent top rod 2, and the position at which the support rod 3 is hingedly connected to the lower tent top rod 2 are separated independent hinge point positions; the connecting rod 7, the eave overhanging rod 4, and the pull rod 6 all use the same hinge point position; the connecting rod 7 and the connecting rod 5 are hingedly connected to the slider 31 at the same hinge point position.

The hinge position relationships of the components are optimized. As shown in FIG. 4 to FIG. 10, the lower tent top rod 2, the connecting rod 5, the pull rod 6, and the push rod 7 use a position O at which the eave overhanging rod 4 is hingedly connected to the fixed base 82 as a support center, forming a movable structure similar to a crank link, wherein the lower tent top rod 2 is used as a crank shaft, and the connecting rod 5, the pull rod 6, and the push rod 7 are used as a link for the periphery linkage of the crank; therefore, the motion track of the position at which the eave overhanging rod 4 is hingedly connected to the pull rod 6 is in an arc shape.

When the folding tent is unfolded or folded, the lower tent top rod 2 drives the connecting rod 5 and the pull rod 6 to generate a push and pull motion; the position at which the connecting rod 5 is hingedly connected to the lower tent top rod 2 is closer to the central position than the position at which the pull rod 6 is hingedly connected to the lower tent top rod 2, therefore, a movement distance of the connecting rod 5 is greater than a movement distance of the pull rod 6, as shown in FIG. 1. In a specific motion track, in combination with the change of a mathematical model, the specific process is described as follows.

Figure 7:
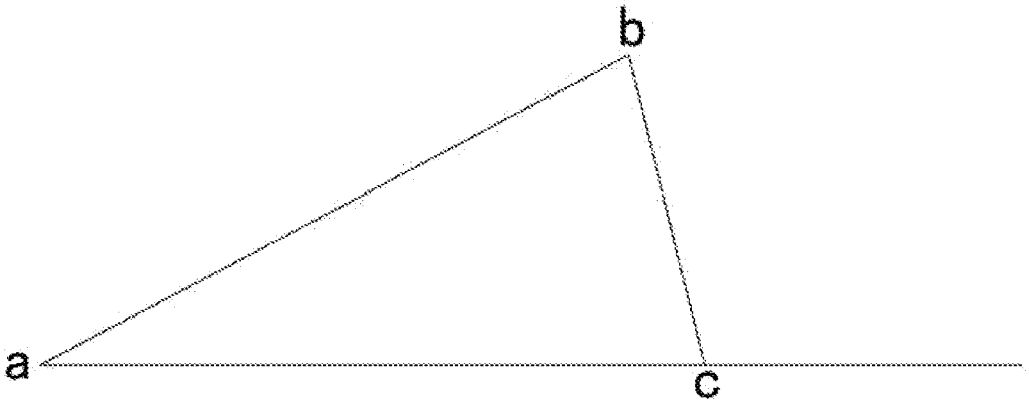
FIG. 7 is a first structural schematic view how a hinge position changes according to the present invention.

Particularly, as shown in FIG. 7 to FIG. 10, in Δabc, the point a is the position at which the support rod 3 is hingedly connected to the lower tent top rod 2; the point b is the common position at which the pull rod 6, the eave overhanging rod 4 and the push rod 7 are hingedly connected; and the point c is the position at which the connecting rod 5 and the push rod 7 are hingedly connected to the slider 31. The point c is a moving point, and can move, together with the slider 31, along the support rod 3. When the point c moves to the position as shown in FIG. 7, the opposite side ac of ∠abc changes from long to short, therefore ∠abc gradually decreases. That is, the position of the side bc deflects, and the distance from the point b to the side ac increases. That is, a height of the triangle increases.

Figure 9:
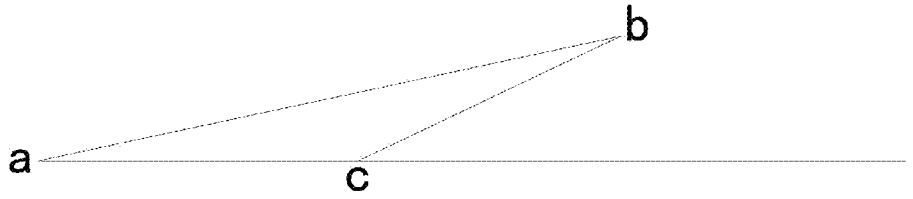
FIG. 9 is a third structural schematic view how the hinge position changes according to the present invention.

When the point c continuously moves to the position as shown in FIG. 9, ∠abc continuously decreases, and the side bc continuously deflects. When ∠abc becomes a right angle, the distance from the point b to the side ac is maximum, and then the distance from the point b to the side ac gradually decreases; in the change process of the distance from the point b to the side ac, the eave overhanging rod deflects and extends outward. If ∠abc exceeds 90 degrees which is a critical point, as shown in FIG. 9, the eave overhanging rod would fail to overhang the eave of the folding tent. In the structure, the force the eave overhanging rod can bear has an upper limit. Furthermore, an external prying structure would be affected by the tarpaulin, causing failure to the unfolding of an overhanging eave of the folding tent.

Figure 10:
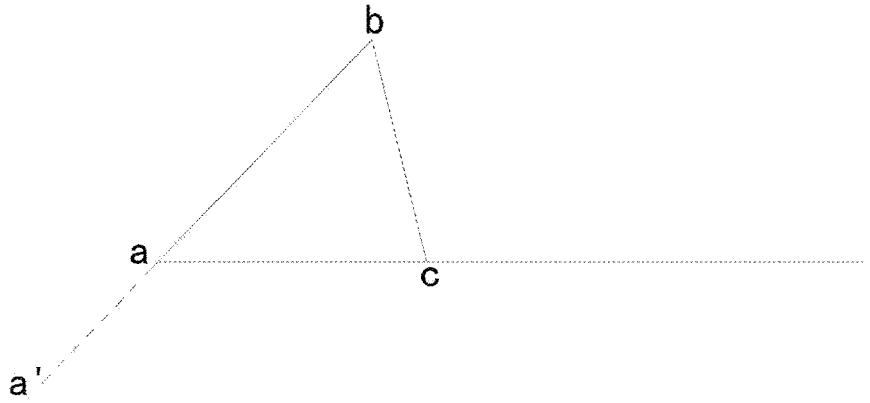
FIG. 10 is a fourth structural schematic view how the hinge position changes according to the present invention.

Therefore, in order to increase the displacement of the point c and ensure the distance from the point b to the side ac to be maximum, the preferred method is to keep the ∠abc at the right angle or about to reach the right angle. However, the position of the point a in the structure is limited. Therefore, as shown in FIG. 10, while the point c moves, the side ab decreases; the original point a is moved to the position a' as shown in FIG. 10; the sides a'b and a'c both decrease, wherein the distance from point b to the side a'c can be approximate to or equal to the distance in the original state.

Figure 4:
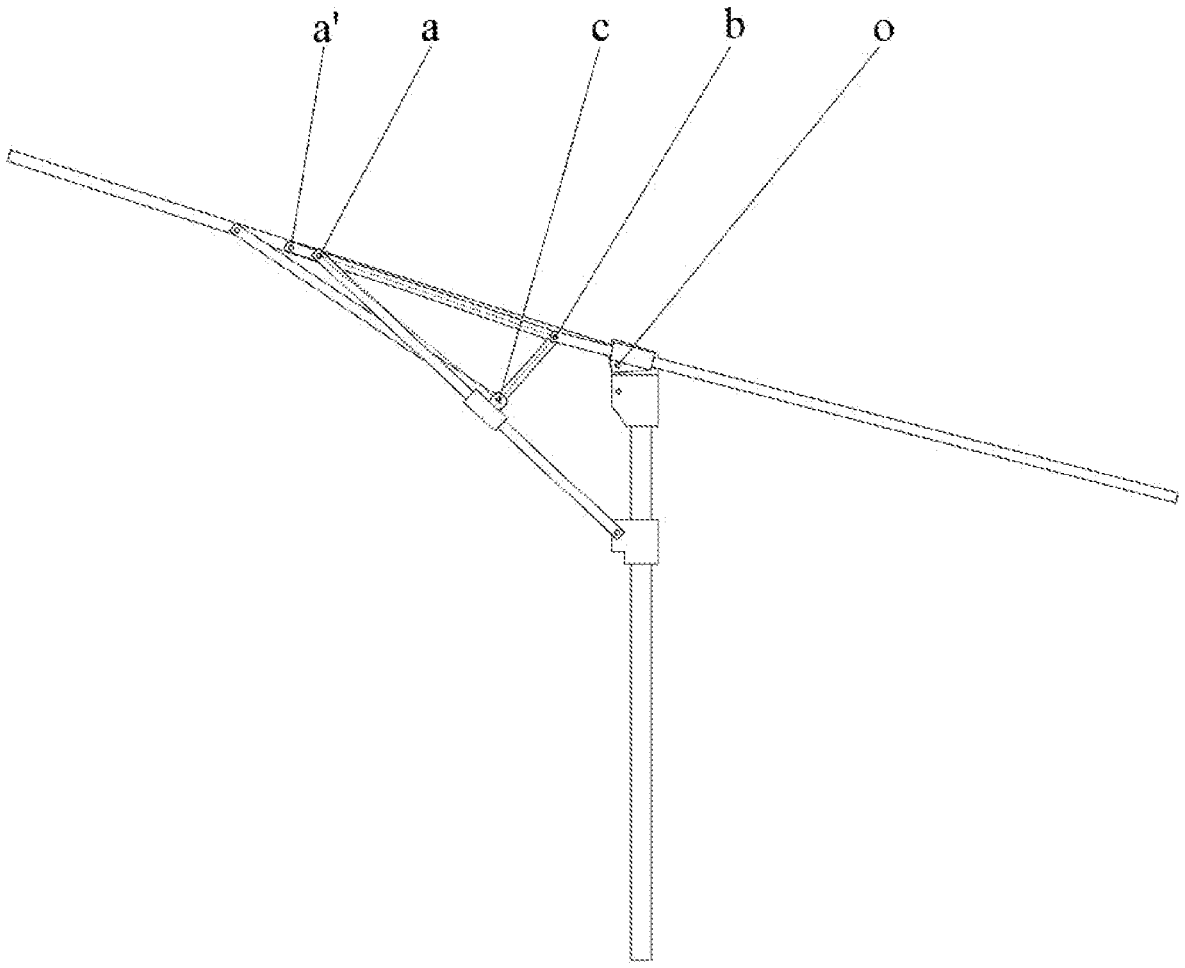
FIG. 4 is a second overall structural diagram of the unfolded overhanging eave according to the present invention.
Figure 5:
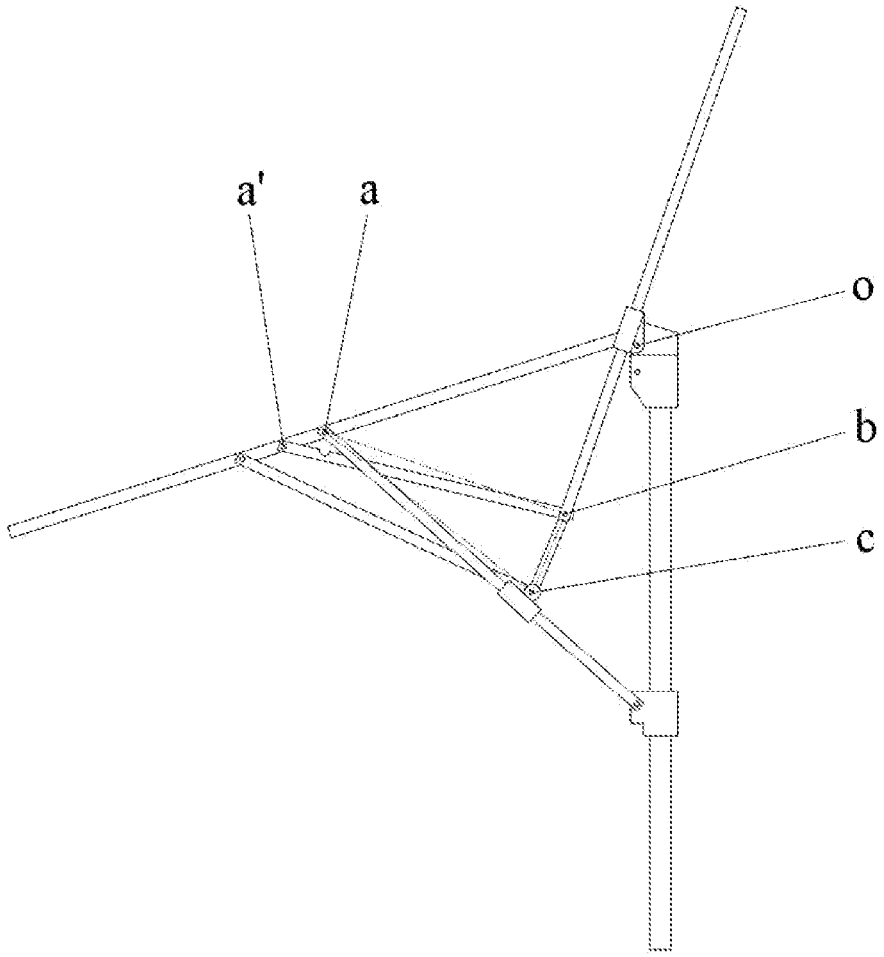
FIG. 5 is a second overall structural diagram of the half-unfolded overhanging eave according to the present invention.
Figure 6:
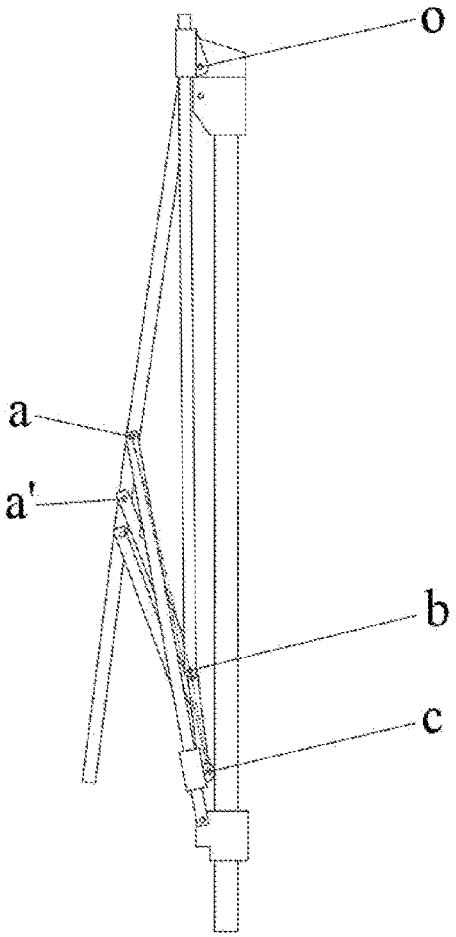
FIG. 6 is a second overall structural diagram of the folded overhanging eave according to the present invention.

It can be seen from FIG. 4 to FIG. 6 that in the unfolding process of the folding tent, the point a' is the position at which the pull rod 6 is hingedly connected to the lower tent top rod 2. The position at which the pull rod 6 is hingedly connected to the lower tent top rod 2 is optimized, and is set in a region between the position at which the connecting rod 5 is hingedly connected to the lower tent top rod 2 and the position at which the support rod 3 is hingedly connected to the lower tent top rod 2. In the folding tents with the same specification, when the position at which the pull rod 6 is hingedly connected to the lower tent top rod 2 is set from the position at which the support rod 3 is hingedly connected to the lower tent top rod 2 to the position at which the connecting rod 5 is hingedly connected to the lower tent top rod 2, the folding tent is gradually unfolded, and the length of the side ab changes with the position change of the point a'. Specifically, the closer the point a' gets to the position at which the connecting rod 5 is hingedly connected to the lower tent top rod 2, the smaller the length of the side ab becomes. The eave overhanging rod 4 can be configured to be longer, so as to improve the outward overhanging length.

Figure 11:
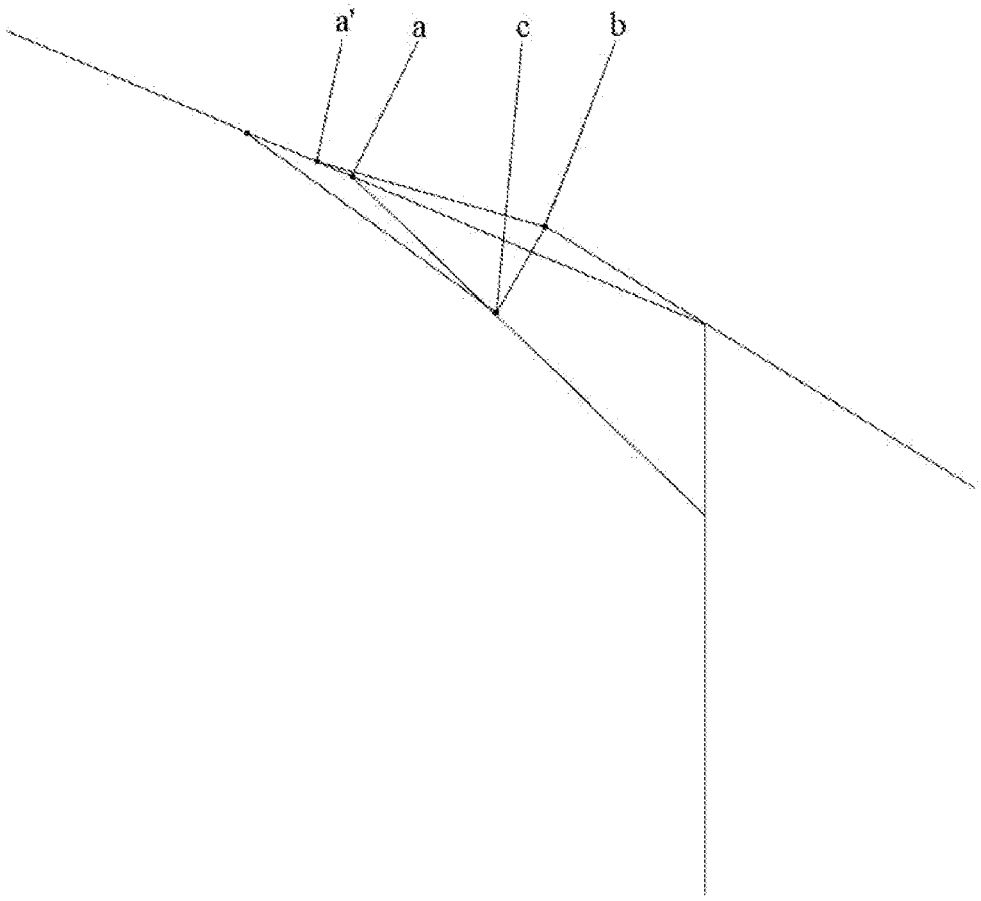
FIG. 11 is a first overall structural schematic view of a failed overhanging eave according to the present invention.
Figure 12:
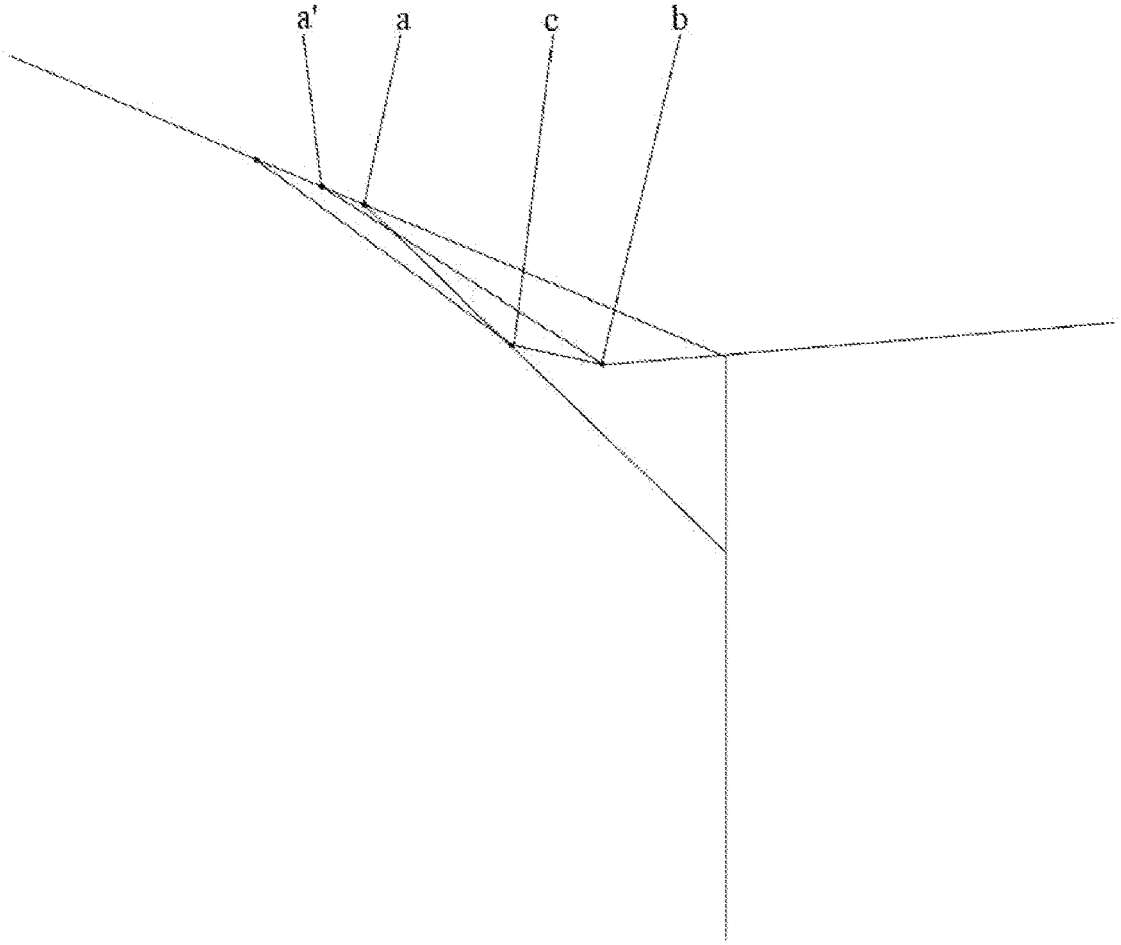
FIG. 12 is a second overall structural schematic view of the failed overhanging eave according to the present invention.

Furthermore, after the folding tent is unfolded, the position at which the push rod 7, the eave overhanging rod 4, and the pull rod 6 are hingedly connected is not higher than an upper surface of the lower tent top rod 2. The configuration of the push rod 7 is optimized. The length of the push rod 7 is reasonably calculated. In combination with the above description, the length of the push rod 7 is preferably the length of the side bc. The push rod 7 can ensure that no excessive deflection occurs, namely ensures the normal deflection of the eave overhanging rod 4, thereby avoiding the excessive deflection problem of the eave overhanging rod 4, as shown in FIG. 12. In addition, the push rod 7 is prevented from pushing up, thereby avoiding the situation as shown in FIG. 11.

Figure 2:
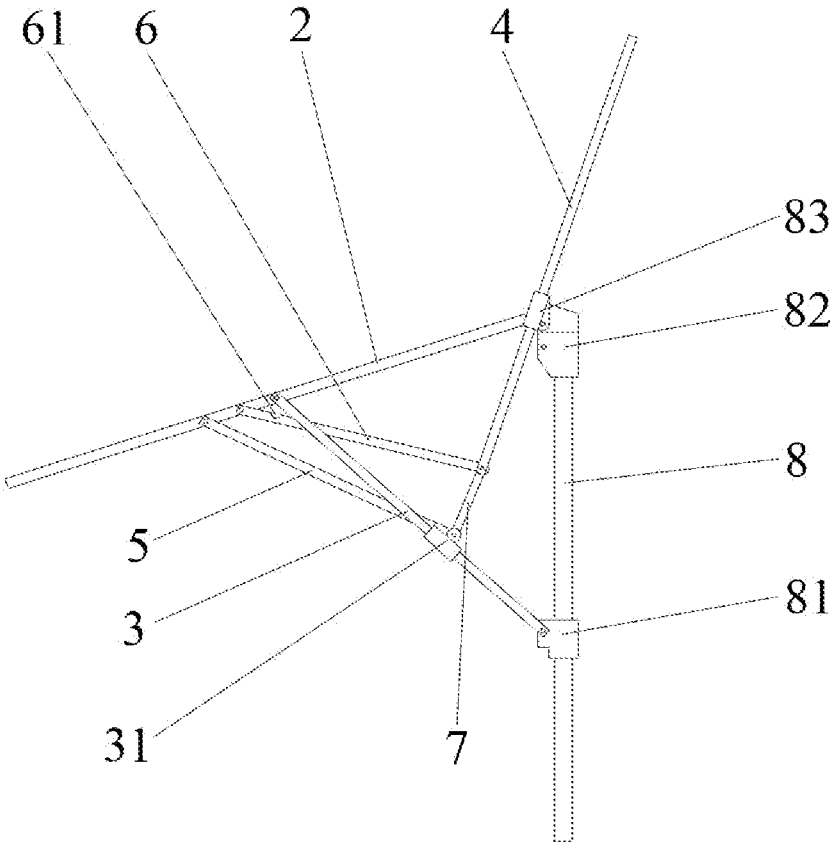
FIG. 2 is a first overall structural diagram of a half-unfolded overhanging eave according to the present invention.
Figure 3:
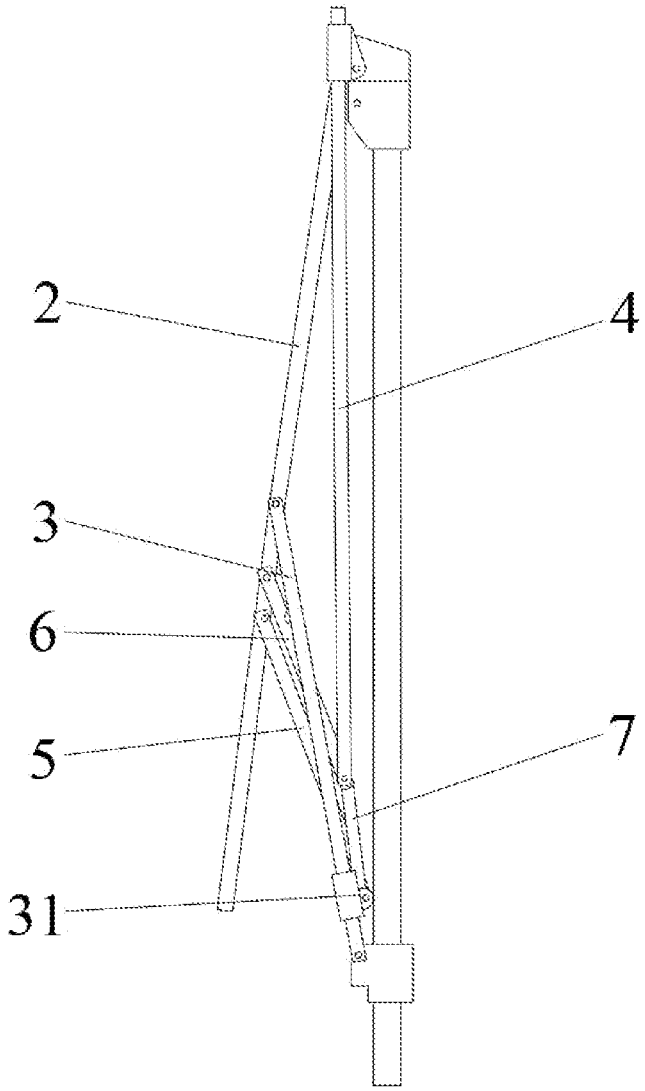
FIG. 3 is a first overall structural diagram of a folded overhanging eave according to the present invention.

Preferably, as shown in FIG. 2, the pull rod 6 is provided thereon with an accommodation groove 61; the accommodation groove 61 is used to correspond to the position at which the support rod 3 is hingedly connected to the lower tent top rod 2; the structural design is optimized; after the folding tent is completely unfolded, the interference between the pull rod 6, the support rod 3, and the lower tent top rod 2 is avoided.

Preferably, the push rod 7, the connecting rod 5, and the pull rod 6 are all made from a thin strip-shaped rod, so as to reduce the overall volume; therefore, the push rod 7, the connecting rod 5, and the pull rod 6 can be accommodated in a space enclosed by the support rod 3, the lower tent top rod 2, and the leg pipe 8.

Figure 14:
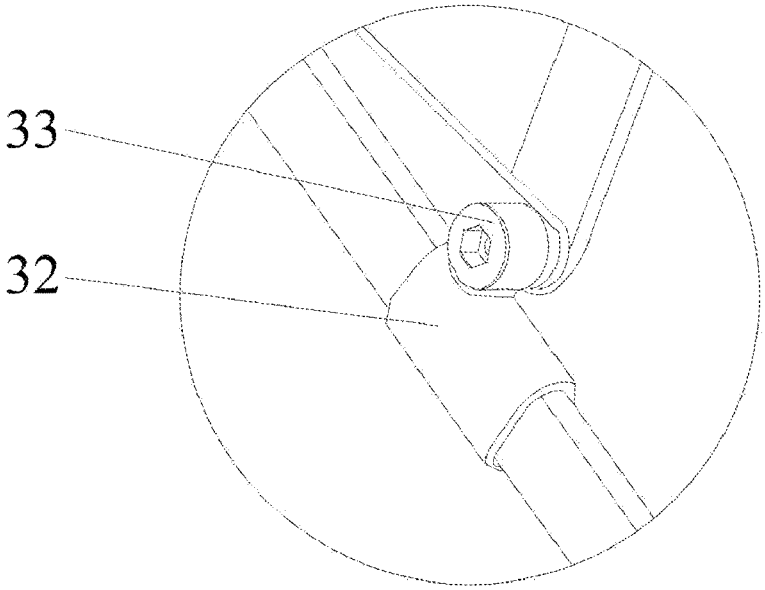
FIG. 14 is a structural schematic view of a slider according to the present invention.

Preferably, as shown in FIG. 14, the slider 31 includes a slide sleeve portion 32 and a mounting portion 33, wherein the slide sleeve portion 32 is sleeved on the support rod 3, and can slide along the support rod 3; and the mounting portion 33 is hingedly connected to the push rod 7 and the connecting rod 5. The structural design of the slide sleeve portion 32 facilitates component mounting. Furthermore, the sliding stability thereof is relatively good. In the other embodiments, a sliding structure between the slider 31 and the support rod 3 can use a half-coated slide sleeve, a fully coated slide sleeve and the like, and can also use a slide rail and a slide groove.

Figure 13:
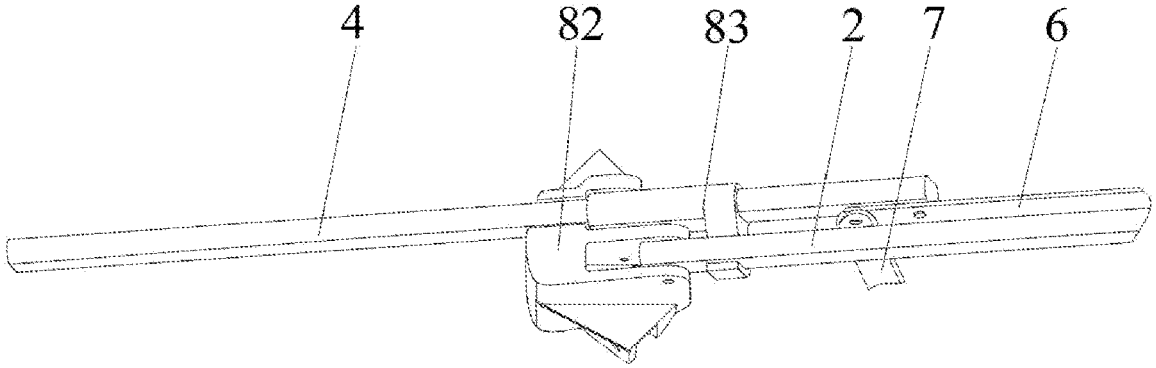
FIG. 13 is a structural schematic view how an eave overhanging rod and a fixed base are mounted according to the present invention.

Preferably, as shown in FIG. 13, an eave overhanging slide sleeve 83 is disposed between the eave overhanging rod 4 and the fixed base 82; the eave overhanging rod 4 penetrates through the eave overhanging slide sleeve 83, and extends outward; a hinge portion is disposed on the eave overhanging slide sleeve 83; the hinge portion is hingedly connected to the fixed base 81; and the eave overhanging slide sleeve 83 rotates with the movement of the eave overhanging rod 4.

In the present embodiment, in order to realize better fit between the eave overhanging rod 4 and the fixed base 82, the eave overhanging slide sleeve 83 is disposed between the eave overhanging rod 4 and the fixed base 82; the eave overhanging rod 4 penetrates through the eave overhanging slide sleeve, and extends outward; the eave overhanging rod 4 uses a straight rod structure, and can automatically extend and retract along the eave overhanging slide sleeve 83; the hinge portion is disposed on the eave overhanging slide sleeve 83; the hinge portion is hingedly connected to the fixed base 82; the eave overhanging slide sleeve 83 rotates with the movement of the eave overhanging rod 4, wherein the eave overhanging slide sleeve 83 realizes overturn and outward extension along the fixed base 82.

In a preferred embodiment, the eave overhanging slide sleeve 83 is provided thereon with a limit hook; when the eave overhanging rod 4 unfolds the overhanging eave, the limit hook is used to fasten the lower tent top rod 2, so as to transversely fix the eave overhanging rod 4 to the lower tent top rod 2. On the basis of another alternative embodiment, the limit hook and the eave overhanging slide sleeve 83 are split, wherein the eave overhanging slide sleeve 83 is rotatably disposed on the fixed base 82 by means of the hinge portion; the eave overhanging slide sleeve 83 deflects with the movement of the eave overhanging rod 4; the limit hook is sleeved on the eave overhanging rod 4; when the eave overhanging rod 4 unfolds the overhanging eave the limit hook can fasten the lower tent top rod 2, so as to transversely fix the eave overhanging rod 4 to the lower tent top rod 2.

In the present embodiment, the eave overhanging rod can extend and retract by using the position changes of the connecting rod, the push rod, and the pull rod; the hinge position relationships between the pull rod, the connecting rod and the lower tent top rod are optimized; the eave overhanging rods in various lengths can be selected; the extension length of the eave overhanging rod can be improved, thereby realizing a folding tent with extended eave overhanging rods; the eave overhanging rod uses a straight rod structure, and the components are designed in a staggered manner, thereby realizing no interference and contact after the tent is folded; the eave overhanging rod is at a position in parallel with the upper tent top rod and the lower tent top rod after the tent is folded, thereby reducing the overall size of the folded tent, saving space to the most extent, reducing the volume of the overall package, facilitating transportation and storage, and reducing cost; the structural design of the connector and the eave overhanging slide sleeve is optimized, thereby improving the transverse fixation firmness of the components, improving the overall mounting strength, preventing the eave overhanging rod from shaking after the tent is folded, and improving the tarpaulin stretching effect.

Embodiment 2

On the basis of embodiment 1, as shown in FIG. 19 to FIG. 26, the biggest structural difference over embodiment 1 is that: in the present embodiment, the other end of the pull rod 6 is hingedly connected to the lower tent top rod 2; the pull rod 6 is hingedly connected to the lower tent top rod 2 at the same position that the support rod 3 is hingedly connected to the lower tent top rod 2; in combination with the description of embodiment 1, the position of the point a' coincides with the position of the point a; in the structural design, the extension length of the eave overhanging rod 4 is less than that in embodiment 1, and the eave overhanging rod is applicable to the folding tents with different specifications.

Compared with embodiment 1, the length of the eave overhanging rod 4 in the present embodiment is limited by the mounting position of the pull rod 6; the eave overhanging rod 4 must be retracted to the minimum when the folding tent is folded; the slider 31 is at the bottommost of a bottom dead center on the support rod 3, such that the displacement distance of the slider 31 on the support rod 3 is long. In order to guarantee the effective length of the side bc, the variation of the side ac is large. In combination with the triangle principle that the sum of the lengths of two sides is greater than that of the third side, the sum of the length of the pull rod 6 and the length of the push rod 7 must be greater than a movable distance of the slider 31 on the support rod 3. In addition, the sum of the sliding distance of the slider 31 from a top dead center on the support rod 3 to the position at which the support rod 3 is hingedly connected to the pull rod 6 and the length of the push rod 7 also must be greater than the length of the pull rod 6.

After the folding tent is unfolded, the position at which the push rod, the eave overhanging rod, and the pull rod are hingedly connected is not higher than the upper surface of the lower tent top rod, otherwise the push rod and the eave overhanging rod would exceed a tent roof after the folding tent is unfolded, resulting in an unfolding failure.

Figure 27:
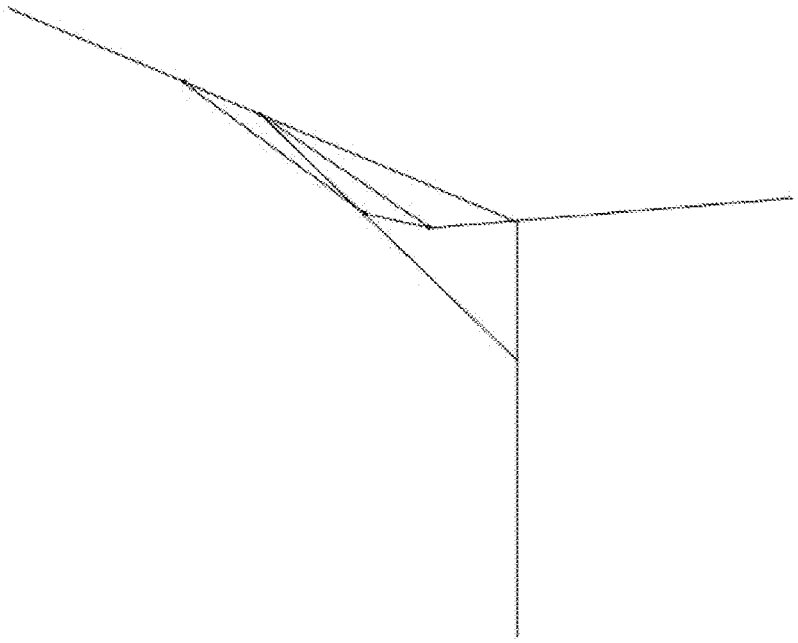
FIG. 27 is a third overall structural schematic view of the failed overhanging eave according to the present invention.

If the pull rod is extended, then an angle between the push rod and the pull rod will become small. Due to the too small angle, the push rod would be easy to deflect excessively, and therefore cannot drive the eave overhanging rod to deflect, as shown in FIG. 27.

In the deformable triangle structure formed by the support rod, the pull rod, and the push rod, the length of the side on which the support rod is located cannot change greatly. That is, the slider cannot displace for a long distance. The displacement of the slider on the support rod is proportional to the extension length of the eave overhanging rod. Therefore, in the structure, the extension length of the eave overhanging rod is limited. However, the number of the hinge points is reduced, thereby simplifying the mounting structure. The specific structure is described as follows.

In the present embodiment, the support rod 3 is provided thereon with a slider 31; the slider 31 is hingedly connected to one end of the connecting rod 5; the other end of the connecting rod 5 is hingedly connected to the lower tent top rod 2; the position at which the connecting rod 5 is hingedly connected to the lower tent top rod 2 is located on one side of the position at which the support rod 3 is hingedly connected to the lower tent top rod 2, and is adjacent to the center of the folding tent.

The hinge point between the connecting rod 5 and the lower tent top rod 2, the hinge point between the support rod 3 and the lower tent top rod 2, and the hinge point between the connecting rod 5 and the slider 31 are three vertexes of the triangle. The slider 31 is a moving point. Therefore, the triangle formed by the three points is a deformable triangle.

Figure 8:
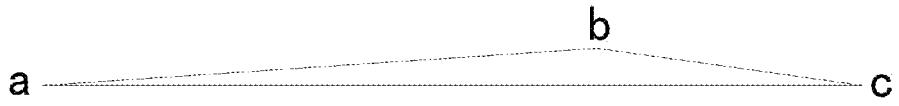
FIG. 8 is a second structural schematic view how the hinge position changes according to the present invention.

As shown in FIG. 7 and FIG. 8, when the lower tent top rod 2 turns up, in the triangle, the angle between the lower tent top rod 2 and the connecting rod 5 becomes small, while the lengths of the two sides remain unchanged. Therefore, the length of the side opposite to the angle becomes small. That is, the distance from the hinge point between the support rod 3 and the lower tent top rod 2 to the hinge point between the slider 31 and the connecting rod 5 becomes small. In other words, when the slider 31 moves upward along the support rod 3, namely when the lower tent top rod 2 turns up, the connecting rod 5 pulls the slider 31 to move upward along support rod 3.

The slider 31 is further hingedly connected to the push rod 7; the other end of the push rod 7 is hingedly connected to the pull rod 6; the other end of the pull rod 6 is hingedly connected to the support rod 3; and the pull rod and/or the push rod are/is further hingedly connected to the eave overhanging rod. It is particularly noted that in the present embodiment, in order to facilitate manufacturing and save process steps, the other end of the pull rod 6 is hingedly connected to the support rod 3 and the lower tent top rod 2 at the same hinge point.

In the above structure, the support rod 3, the pull rod 6, and the push rod 7 form a deformable triangle structure. Specifically, the three points of the deformable triangle structure are: the hinge point between the support rod 3 and the pull rod 6, the hinge point formed between the push rod 7 and the support rod 3 by means of the slider 31, and the hinge point between the pull rod 6 and the push rod 7.

In the deformable triangle, the length of the side on which the support rod 3 is located is a part of the total length of the support rod 3, and varies with the position change of the slider 31; and the other two sides represented by the pull rod 6 and the push rod 7 have fixed lengths.

According to relevant triangle theorems, when the length of the side on which the support rod 3 is located becomes small, the angle opposite thereto becomes small. Finally, the push rod 7 and the pull rod 6 form an arc therebetween, and the eave overhanging rod 4 is pushed upward and turns outward around the hinge point between the eave overhanging slide sleeve 83 and the fixed base 82.

The slide base 81 moves upward, and drives the entire eave overhanging rod to move upward by means of the support rod 3 and the slider 31. The outward turning and the overall upward movement of the eave overhanging rod finally stretch and unfold the eave overhanging structure.

The eave overhanging rod 4 is a straight rod. When the folding tent is folded, the eave overhanging rod 4 can be at a position basically in parallel with the top tent top rod 1 and the lower tent top rod 2, thereby causing no contact therebetween, reducing the overall size of the folded tent, saving space to the most extent, and reducing the overall package volume.

After the folding tent is folded, the distance between the fixed base 82 and the slide base 81, namely the length of a longest diagonal line of a rhombus formed by intersected rods connected to the leg pipes of the folding tent, determines the size of a projected area after the folding tent is unfolded. Therefore, the distance generally has a fixed specification.

In addition, the sum of the length of the eave overhanging rod 4, the length of the push rod 7, and the distance from the hinge point of the eave overhanging rod 4 to the hinge point of the pull rod 6 and/or the push rod 7 cannot be less than the distance from the slide base 81 to the fixed base 82 on the leg pipe 8 after the folding tent is folded, thereby preventing the folding tent from falling apart because an outer end of the eave overhanging rod 4 slides out of the eave overhanging slide sleeve 83 after the folding tent is folded.

In order to satisfy different sun-shading requirements, different parameters need to be set for the eave overhang length. The eave overhang rod 4 can be hingedly connected to the pull rod 6 at different positions. The specific hinge position can be set according to the eave overhanging requirement of a product, and can be correspondingly adjusted to satisfy the requirements of the products with different specifications for the extension length of the eave overhanging rod 4.

In one embodiment, as shown in FIG. 19 to FIG. 23, the other end of the pull rod 6 is hingedly connected to the lower tent top rod 2; the pull rod 6 is hingedly connected to the lower tent top rod 2 at the same position that the support rod 3 is hingedly connected to the lower tent top rod 2; the structural design is optimized to reduce the quantity of the hinge points, thereby enabling the overall assembly to be more convenient, having a good overhanging effect, and being applicable to the folding tents with different specifications.

Figure 24:
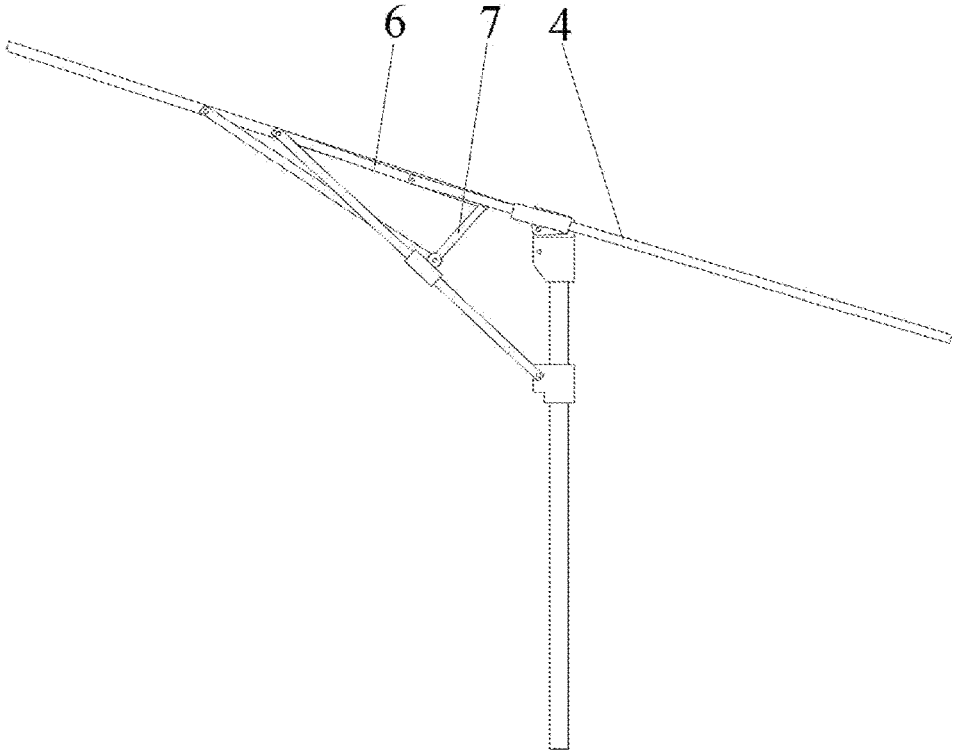
FIG. 24 is a sixth overall structural diagram of the unfolded overhanging eave according to the present invention.
Figure 25:
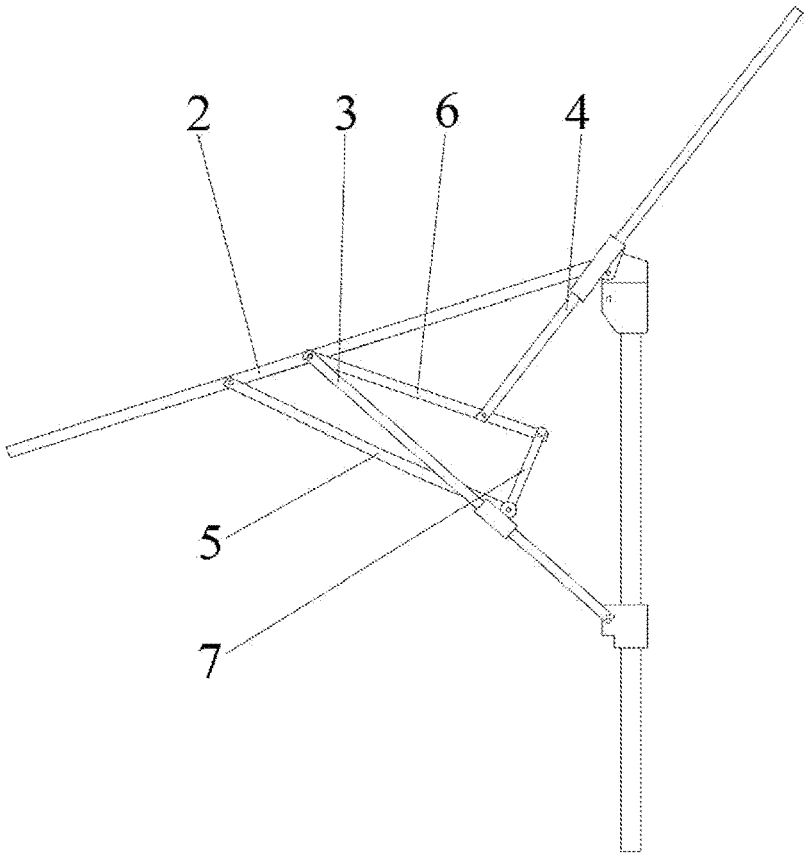
FIG. 25 is an overall structural diagram of the half-unfolded overhanging eave in FIG. 24 according to the present invention.

In one embodiment, if a short eave overhanging length is required, as shown in FIG. 24 and FIG. 25, the eave overhanging rod 4 is hingedly connected to the pull rod 6 at a position separated from the position at which the pull rod 6 is hingedly connected to the push rod 7. An inner end of the eave overhanging rod 4 is closer to the inner side of the folding tent. Therefore, the extension length of the eave overhanging rod 4 is short. It can be seen that the extension length of the eave overhanging rod 4 can be adjusted by setting the hinge point at different positions.

In another embodiment, if a long eave overhanging length is required, the eave overhanging rod 4 can be hingedly connected to the pull rod 6 at the same position that the pull rod 6 is hingedly connected to the push rod 7, in which case the extended part of the unfolded eave overhanging rod is maximum, and the eave overhanging length is the longest.

Figure 26:
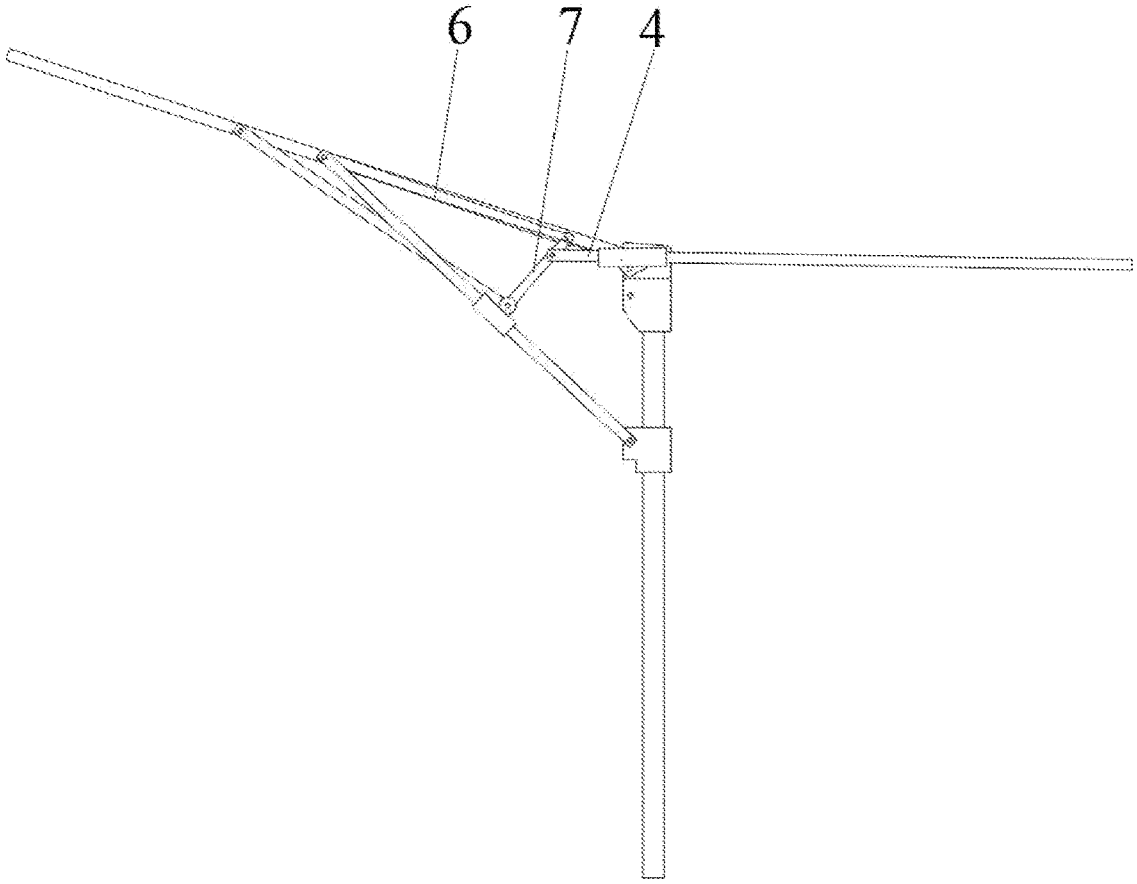
FIG. 26 is a seventh overall structural diagram of the unfolded overhanging eave according to the present invention.

In another embodiment, according to different sun-shading requirements, the uplifting angle, namely elevation angle, of the overhanging eave also needs to be set differently. The eave overhanging rod 4 is hingedly connected to the push rod 7, enabling the elevation angle of the overhanging eave to be larger. Specifically, as shown in FIG. 26, the eave overhanging rod 4 rises higher relative to the other embodiments, such that the entire overhanging eave is flatter, and a doorway of the folding tent is higher and wider.

Therefore, in specific embodiments, how the inner end of the eave overhanging rod 4 is hingedly connected can be voluntarily selected according to the size parameter of the folding tent, a use requirement of a client and the like.

When the folding tent is stretched from a folded state to an unfolded state, the slide base 81 moves upward along the leg pipe 8; then, a central lock is unlocked; and finally the folding tent is unfolded with one hand. The slide base 81 slides upward with the unlocking of the central lock. Alternatively, a user can push the slide base 81 to slide, so as to unfold the folding tent.

With the move of the slide base 81, the support rod 3 is driven to push and unfold the lower tent top rod 2. The lower tent top rod 2 generally changes from a vertical state to a horizontal state. With the action of the lower tent top rod 2, the lower tent top rod 2 drives the connecting rod to pull the slider 31; then, the slider 31 drives the push rod 7 to push the pull rod 6; and finally, the pull rod drives the eave overhanging rod 4. Furthermore, the slide base 81 moves upward, and drives the entire eave overhanging rod 4 to move upward by means of the support rod 3 and the slider 31. Finally, the eave overhanging rod 4 extends out and turns over, so as to stretch and unfold the eave overhanging structure.

The eave overhanging rod 4 is movably erected on the fixed base 82 by means of, for example, a common elongated hone structure in the prior art. That is, the fixed base 82 is provided thereon with an elongated hole. The eave overhanging rod 4 penetrates through the elongated hole, such that the eave overhanging rod 4 can freely turn over and extend out. The structure is common general knowledge, and will not be repeated here.

In order to realize better fit between the eave overhanging rod 4 and the fixed base 82, in a preferred embodiment of the present invention, the eave overhanging slide sleeve 83 is disposed between the eave overhanging rod 4 and the fixed base 82; the eave overhanging rod 4 penetrates through the eave overhanging slide sleeve, and extends outward; the eave overhanging rod 4 uses a straight rod structure, and can automatically extend and retract along the eave overhanging slide sleeve 83; the hinge portion is disposed on the eave overhanging slide sleeve 83; the hinge portion is hingedly connected to the fixed base 82; the eave overhanging slide sleeve 83 rotates with the movement of the eave overhanging rod 4, wherein the eave overhanging slide sleeve 83 realizes overturn and outward extension along the fixed base 82.

The slider 31 includes a slide sleeve portion 32 and a mounting portion 33, wherein the slide sleeve portion 32 is sleeved on the support rod 3, and can slide along the support rod 3; and the mounting portion 33 is hingedly connected to the push rod 7 and the connecting rod 5. The structural design of the slide sleeve portion 32 facilitates component mounting. Furthermore, the sliding stability thereof is relatively good. In the other embodiments, a sliding structure between the slider 31 and the support rod 3 can use a half-coated slide sleeve, a fully coated slide sleeve and the like, and can also use a slide rail and a slide groove.

Preferably, the push rod 7, the connecting rod 5, and the pull rod 6 are all made from a thin strip-shaped rod, so as to reduce the overall volume; therefore, the push rod 7, the connecting rod 5, and the pull rod 6 can be accommodated in a space enclosed by the support rod 3, the lower tent top rod 2, and the leg pipe 8.

Figure 15:
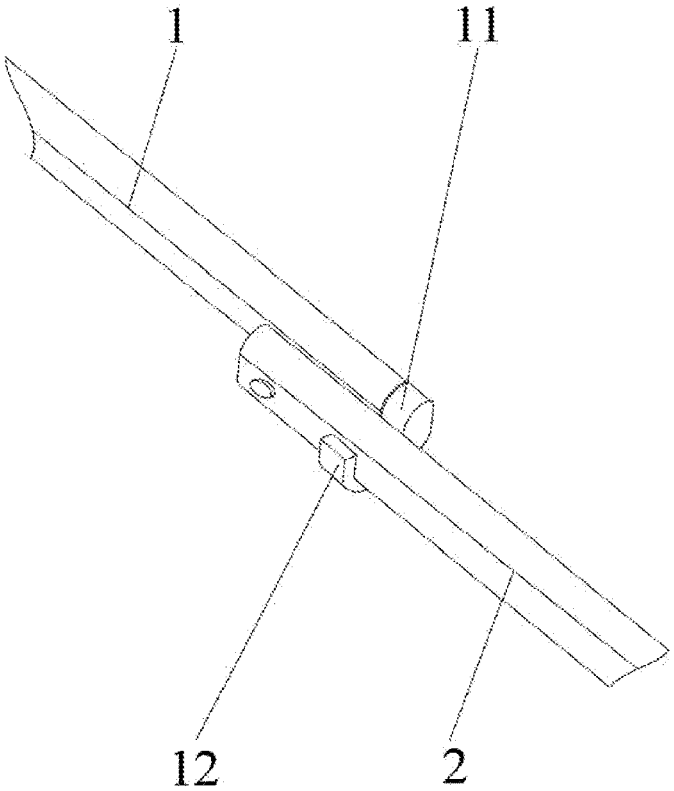
FIG. 15 is a first structural schematic view how an upper tent top rod and a lower tent top rod are connected according to the present invention.
Figure 16:
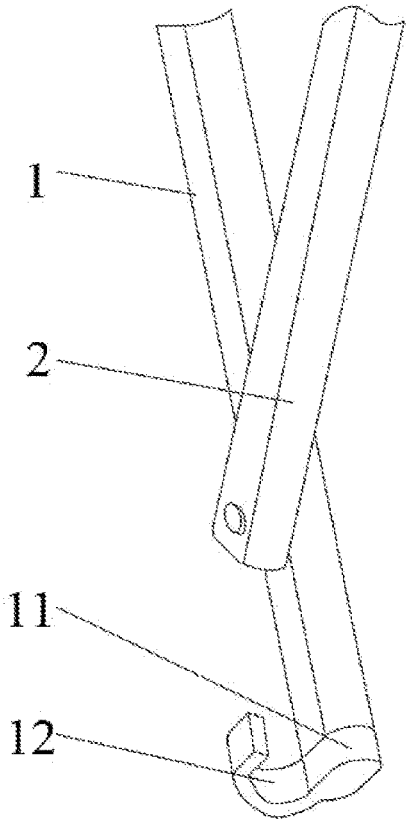
FIG. 16 is a second structural schematic view how the upper tent top rod and the lower tent top rod are connected according to the present invention.
Figure 17:
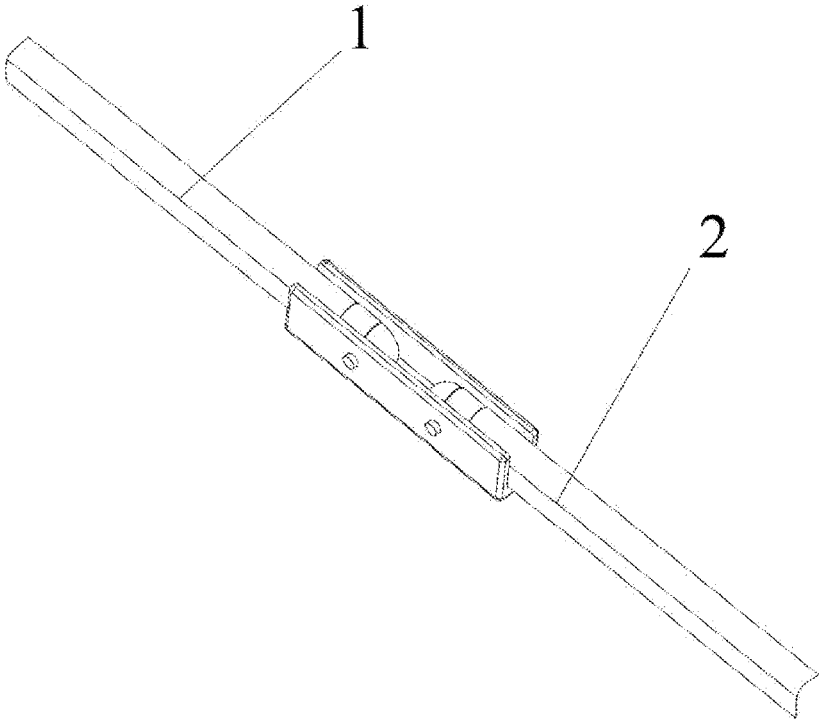
FIG. 17 is a first structural schematic view how the upper tent top rod and the lower tent top rod are connected in the prior art of the present invention.
Figure 18:
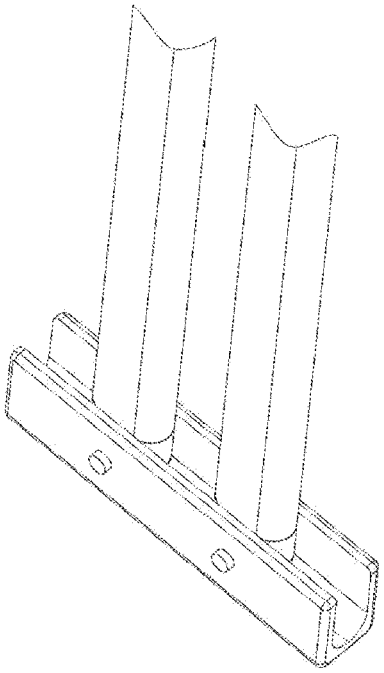
FIG. 18 is a second structural schematic view how the upper tent top rod and the lower tent top rod are connected in the prior art of the present invention.
Figure 19:
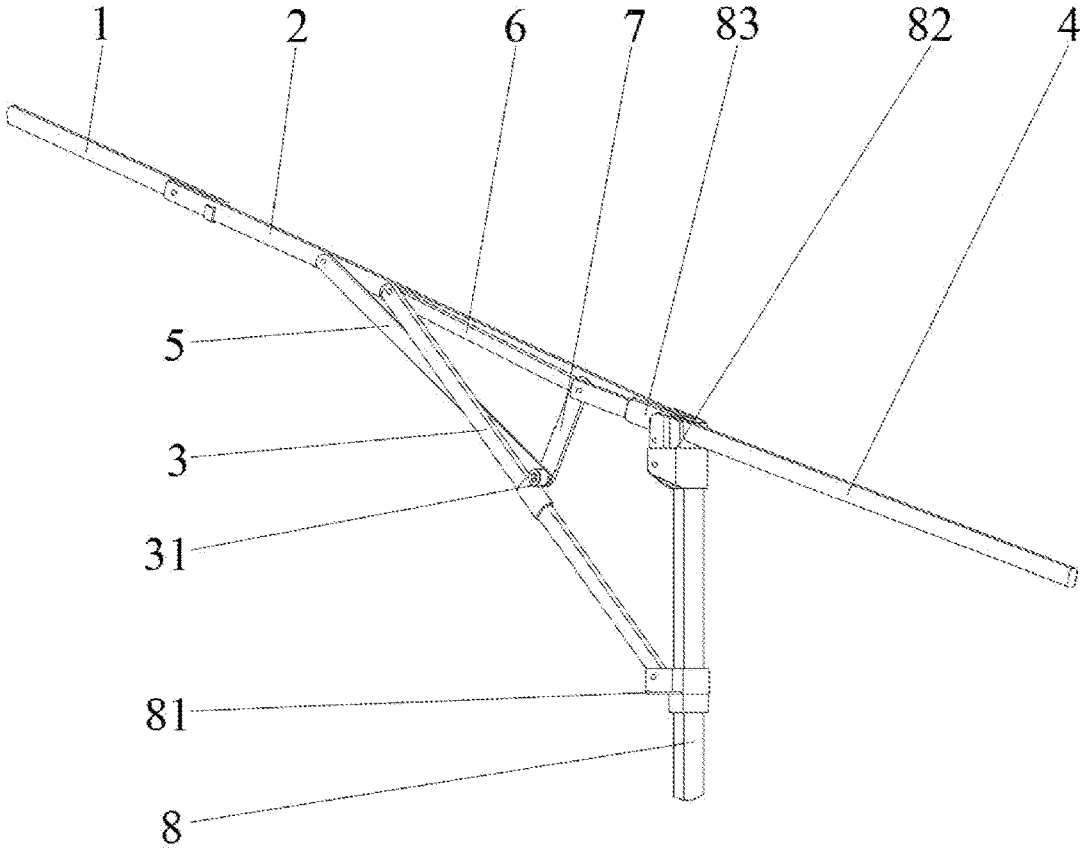
FIG. 19 is a third overall structural diagram of the unfolded overhanging eave according to the present invention.
Figure 20:
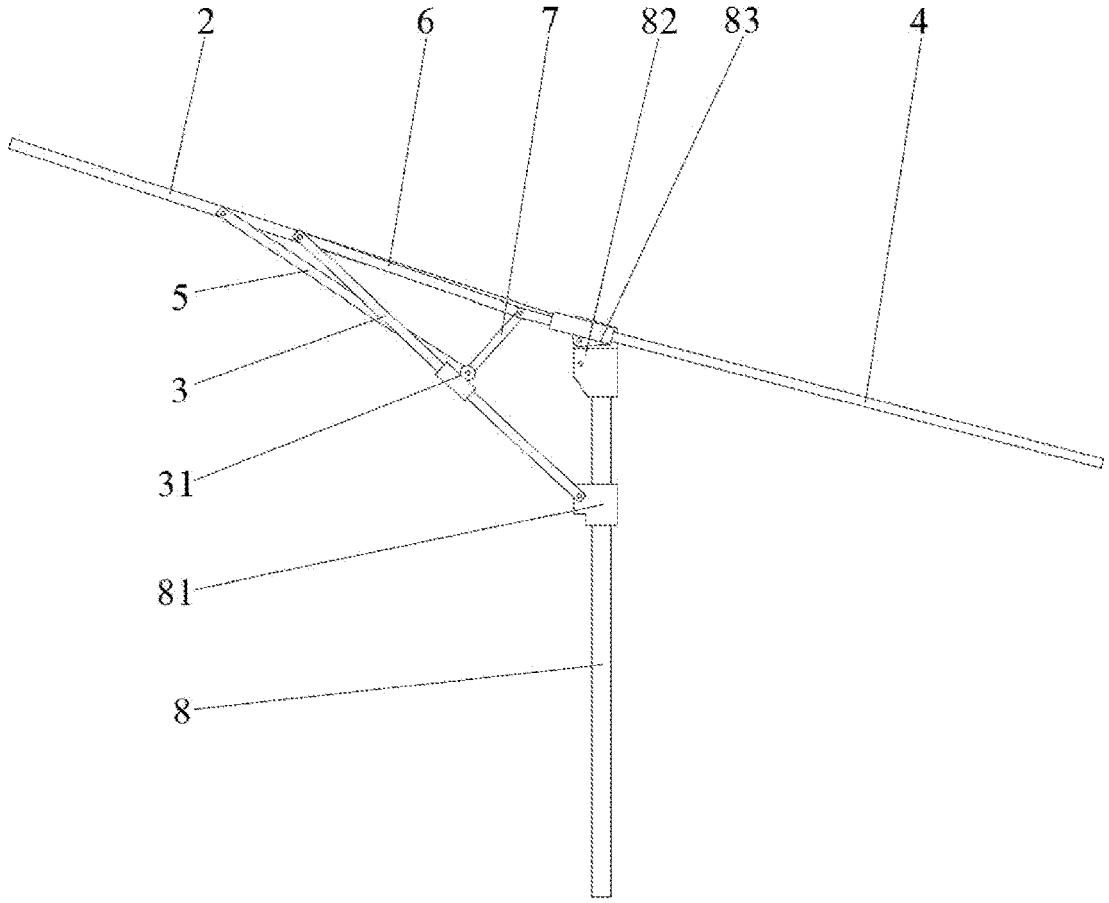
FIG. 20 is a fourth overall structural diagram of the unfolded overhanging eave according to the present invention.
Figure 21:
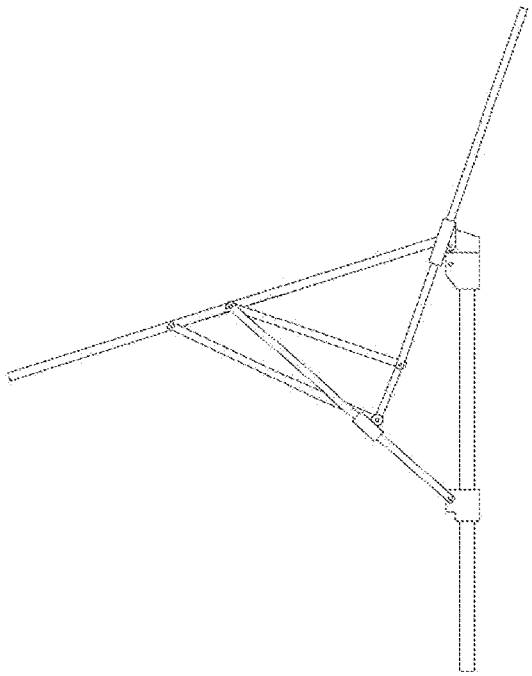
FIG. 21 is a third overall structural diagram of the half-unfolded overhanging eave according to the present invention.
Figure 22:
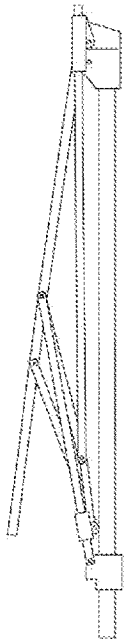
FIG. 22 is a third overall structural diagram of the folded overhanging eave according to the present invention.
Figure 23:
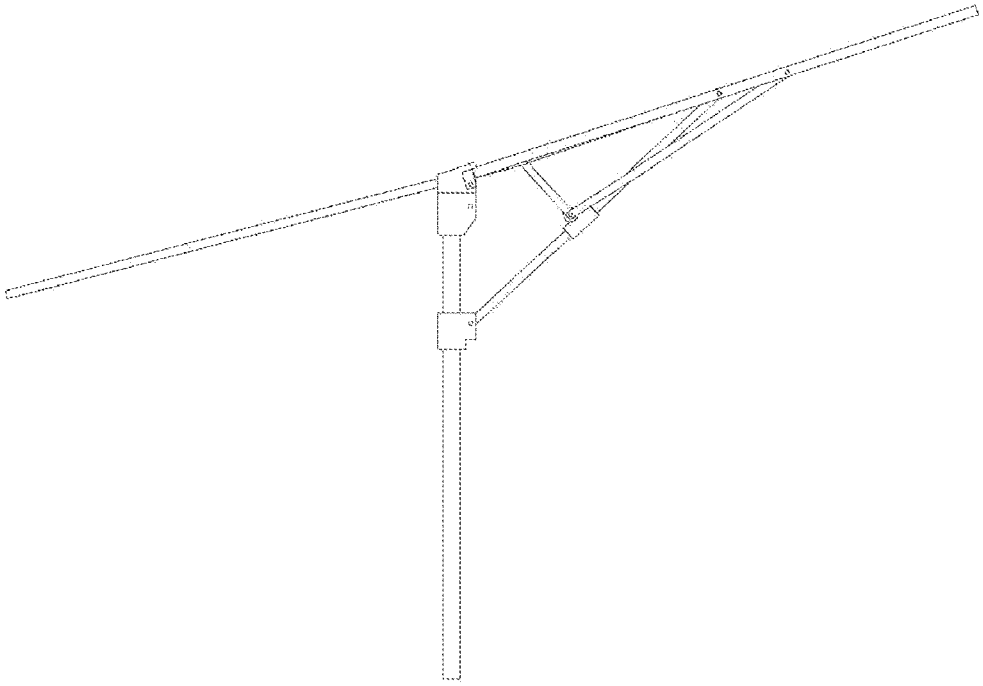
FIG. 23 is a fifth overall structural diagram of the unfolded overhanging eave according to the present invention.

As shown in FIG. 15 and FIG. 16, in a preferred embodiment, any one of the upper tent top rod 1 and the lower tent top rod 2 is provided with a connector 11; the connector 11 is provided thereon with a fastening hook 12; after the folding tent is unfolded, the fastening hook 12 fastens any one of the upper tent top rod 1 and the lower tent top rod 2, so as to transversely fix the upper tent top rod 1 and the lower tent top rod 2. The connector 11 is generally located at one end of the upper tent top rod 1, wherein the upper tent top rod 1 is hingedly connected to the lower tent top rod 2 at a position on one side of the connector 11. Alternatively, the connector and the upper tent top rod can also be located at the same position, wherein the fastening hook 12 is disposed on one side. After the folding tent is unfolded, the upper tent top rod 1 and the lower tent top rod 2 are generally disposed in parallel, and the fastening hook 12 realizes fastening, so as to complete transverse fixation, thereby improving the overall fixation stability.

Embodiment 3

Figure 28:
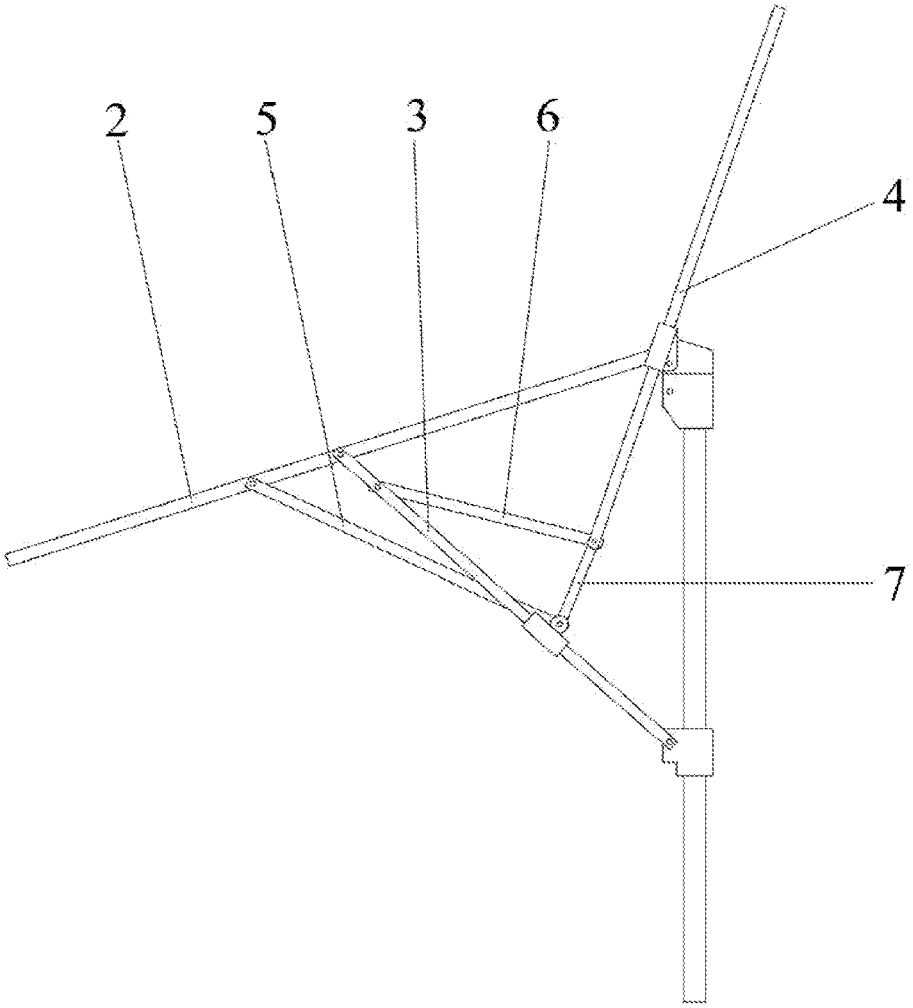
FIG. 28 is a fourth overall structural diagram of the half-unfolded overhanging eave according to the present invention.
Figure 29:
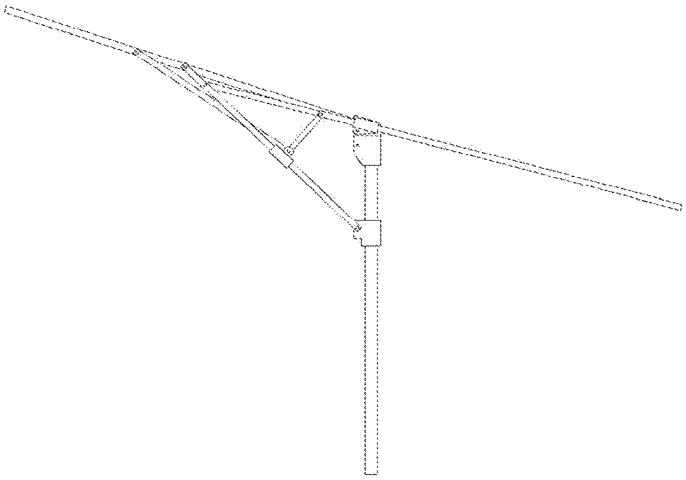
FIG. 29 is an eighth overall structural diagram of the unfolded overhanging eave according to the present invention.

On the basis of the above embodiments, as shown in FIG. 28 and FIG. 29, the present embodiment provides a folding tent eave automatically-overhanging structure applicable to eave overhanging rods in various lengths. Compared with the above structure, the present embodiment adopts the structure that the other end of the pull rod 6 is hingedly connected to the support rod 3. The structural design is optimized, such that the size of the pull rod 6 can be reduced, thereby facilitating mounting. The pull rod 6, the push rod 7, and a side formed between the slider 31 in the support rod 3 and the position at which the support rod 3 is hingedly connected to the pull rod 6, the three form a deformable triangle structure. By using the changeable structure of the side formed between the slider 31 in the support rod 3 and the position at which the support rod 3 is hingedly connected to the pull rod 6, and in combination with the corresponding mathematical analog change reference in the above embodiments, the eave overhanging rod 4 can realize eave overhanging.

In summary, in the present invention, the eave overhanging rod can extend and retract by using the position changes of the connecting rod, the push rod, and the pull rod; the eave overhanging rod uses a straight rod structure, and the components are designed in a staggered manner, thereby realizing no interference and contact after the tent is folded; the eave overhanging rod is at a position in parallel with the upper tent top rod and the lower tent top rod after the tent is folded, thereby reducing the overall size of the folded tent, saving space to the most extent, reducing the volume of the overall package, facilitating transportation and storage, and reducing cost; the structural design of the connector and the eave overhanging slide sleeve is optimized, thereby improving the transverse fixation firmness of the components, improving the overall mounting strength, preventing the eave overhanging rod from shaking after the tent is folded, and improving the tarpaulin stretching effect.

It can be seen from technical general knowledge that the present invention can be realized through other embodiments without departing from the spirit or necessary features thereof. Therefore, the above disclosed embodiments are merely illustrative and not exclusive in all respects. All changes made within the scope of the present invention or equivalent to the scope of the present invention are concluded in the present invention.

What is claimed is:

1. A folding tent eave automatically-overhanging structure applicable to eave overhanging rods in various lengths, comprising a leg pipe, a fixed base disposed at an upper part of the leg pipe, a slide base disposed on the leg pipe and capable of sliding up and down along the leg pipe, an eave overhanging rod movably erected on the fixed base and capable of extending outward and retracting inward, wherein the fixed base is hingedly connected to a lower tent top rod, the slide base is hingedly connected to a support rod, an end of the support rod is hingedly connected to the lower tent top rod, a slider capable of sliding along the support rod is disposed on the support rod, the slider is hingedly connected to a connecting rod, an end of the connecting rod is hingedly connected to the lower tent top rod, a position at which the connecting rod is hingedly connected to the lower tent top rod is closer to a central position of the folding tent eave automatically-overhanging structure than a position at which the support rod is hingedly connected to the lower tent top rod, and a push rod, wherein one end of the push rod is hingedly connected to the slider and/or the connecting rod, an end of the push rod is hingedly connected to the eave overhanging rod and/or a pull rod, an end of the pull rod is hingedly connected to the lower tent top rod and/or the support rod, when the folding tent eave automatically-overhanging structure is unfolded, the slide base moves upward, the support rod pushes the lower tent top rod to unfold, the lower tent top rod drives the connecting rod to pull the slider, in combination with an action of the pull rod, the push rod deflects, and finally the eave overhanging rod moves upward and deflects, so as to complete an outward extension of the eave overhanging rod.

2. The folding tent eave automatically-overhanging structure applicable to eave overhanging rods in various lengths according to claim 1, wherein the end of the pull rod is hingedly connected to the lower tent top rod at a position between the position at which the connecting rod is hingedly connected to the lower tent top rod and the position at which the support rod is hingedly connected to the lower tent top rod.

3. The folding tent eave automatically-overhanging structure applicable to eave overhanging rods in various lengths according to claim 1, wherein the end of the pull rod is hingedly connected to the lower tent top rod at a position that the support rod is hingedly connected to the lower tent top rod at.

4. The folding tent eave automatically-overhanging structure applicable to eave overhanging rods in various lengths according to claim 1, wherein the end of the pull rod is hingedly connected to the support rod.

5. The folding tent eave automatically-overhanging structure applicable to eave overhanging rods in various lengths according to claim 1, wherein an inner end of the eave overhanging rod is hingedly connected to the pull rod.

6. The folding tent eave automatically-overhanging structure applicable to eave overhanging rods in various lengths according to claim 1, wherein an inner end of the eave overhanging rod is hingedly connected to the push rod.

7. The folding tent eave automatically-overhanging structure applicable to eave overhanging rods in various lengths according to claim 1, wherein corresponding hinged connection ends of the pull rod, the push rod, and the eave overhanging rod are hingedly connected at a point.

8. The folding tent eave automatically-overhanging structure applicable to eave overhanging rods in various lengths according to claim 1, wherein an accommodation groove is disposed on the pull rod; and the accommodation groove corresponds to the position at which the support rod is hingedly connected to the lower tent top rod.

9. The folding tent eave automatically-overhanging structure applicable to eave overhanging rods in various lengths according to claim 8, wherein the slider comprises a slide sleeve portion and a mounting portion; the slide sleeve portion is sleeved on the support rod and is capable of sliding along the support rod; and the mounting portion is hingedly connected to the push rod and the connecting rod.

10. The folding tent eave automatically-overhanging structure applicable to eave overhanging rods in various lengths according to claim 9, wherein an eave overhanging slide sleeve is disposed between the eave overhanging rod and the fixed base; and the eave overhanging rod penetrates through the eave overhanging slide sleeve and extends outward.

* * * * *